US005700279A

United States Patent [19]

Blando

[11] Patent Number: 5,700,279

[45] Date of Patent: Dec. 23, 1997

[54] APPETIZING PACIFIER

[76] Inventor: Charles Blando, 15 Fletcher St., Brentwood, N.Y. 11717

[21] Appl. No.: 624,813

[22] Filed: Mar. 27, 1996

[51] Int. Cl.[6] ..... A61J 7/00; A61J 17/00

[52] U.S. Cl. ..... 606/236; 606/234; 215/11.1

[58] Field of Search ..... 606/234–236; 604/77; 215/11.1–11.6

[56] References Cited

U.S. PATENT DOCUMENTS

| | | | |
|---|---|---|---|
| 4,193,407 | 3/1980 | Edmark | 606/234 |
| 4,768,510 | 9/1988 | Leung | 606/234 |
| 5,078,734 | 1/1992 | Noble | 606/235 |
| 5,123,915 | 6/1992 | Miller et al. | 606/234 |
| 5,176,705 | 1/1993 | Noble | 606/234 X |
| 5,403,349 | 4/1995 | Rohrig | 606/234 |

*Primary Examiner*—Nancy Mulcare
*Attorney, Agent, or Firm*—Michael I. Kroll

[57] ABSTRACT

An appetizing pacifier (10) comprising a curved mouth guard (12). A nipple (14) is provided. A facility (16) is for attaching the nipple (14) centrally to a concave side (18) of the curved mouth guard (12), so that the nipple (14) will extend from the curved mouth guard (12). A structure (20) within the curved mouth guard (12) and communicating with the nipple (14), is for holding a flavored liquid (22). When the nipple (14) is inserted into a mouth of a baby (24) and the baby (24) sucks on the nipple (14), the baby (24) will self feed on the flavored liquid (22).

17 Claims, 2 Drawing Sheets

APPETIZING PACIFIER

BACKGROUND OF THE INVENTION

1. Field of the Invention

The instant invention relates generally to teething devices and more specifically it relates to an appetizing pacifier.

2. Description of the Prior Art

Numerous teething devices have been provided in prior art that are adapted to calm down babies when the babies chew or suck on the teething devices. While these units may be suitable for the particular purpose to which they address, they would not be as suitable for the purposes of the present invention as heretofore described.

SUMMARY OF THE INVENTION

A primary object of the present invention is to provide an appetizing pacifier that will overcome the shortcomings of the prior art devices.

Another object is to provide an appetizing pacifier that can be used by a baby as a hands free self feeding device to reduce discomfort, especially when the baby is riding in a motor vehicle.

An additional object is to provide an appetizing pacifier that will allow the baby to accept it more quickly, since the flavored liquid is always in the nipple and thereby help the baby to practice their sucking motion.

A further object is to provide an appetizing pacifier that is simple and easy to use.

A still further object is to provide an appetizing pacifier that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
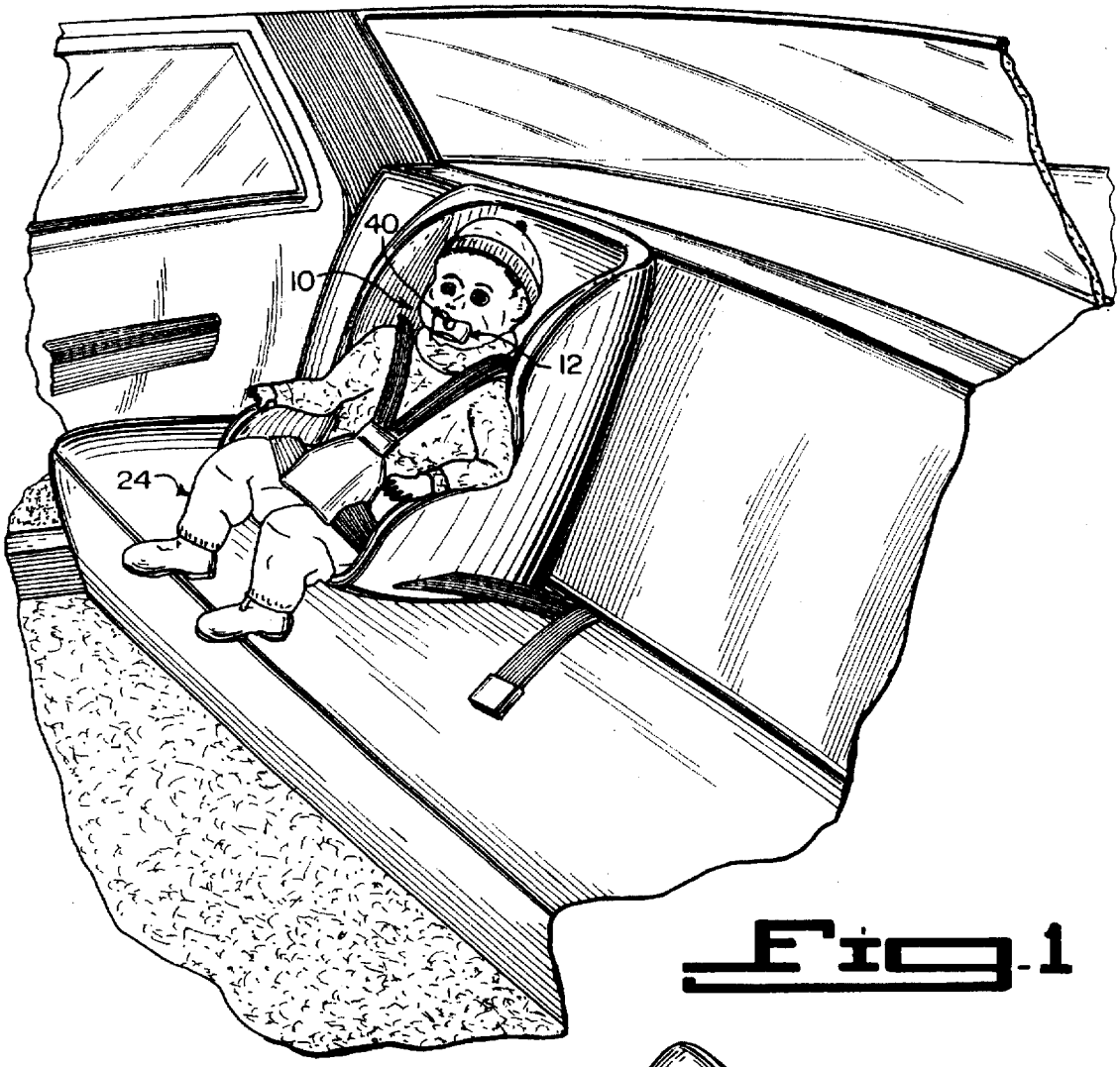
FIG. 1 is a perspective view, showing a baby in a baby seat on a back seat of a motor vehicle using the instant invention.
Figure 2:
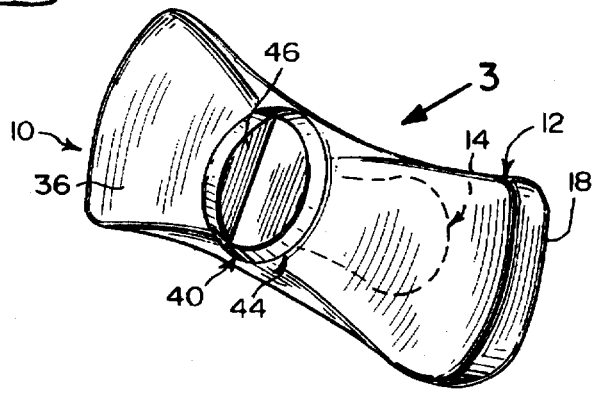
FIG. 2 is an enlarged perspective view of the instant invention per se.
Figure 3:
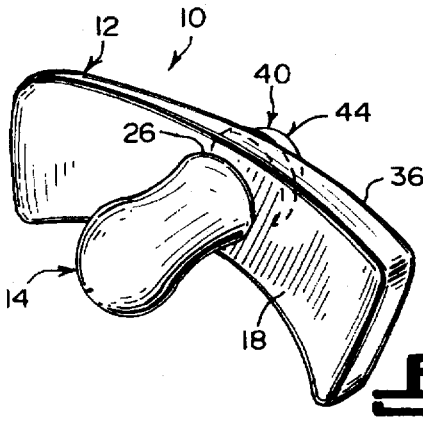
FIG. 3 is a perspective view taken in the direction of arrow 3 in FIG. 2.

Turning now descriptively to the drawings, in which similar reference characters denote similar elements throughout the several views, FIGS. 1 through 5 illustrate an appetizing pacifier 10 comprising a curved mouth guard 12. A nipple 14 is provided. A facility 16 is for attaching the nipple 14 centrally to a concave side 18 of the curved mouth guard 12, so that the nipple 14 will extend from the curved mouth guard 12. A structure 20 within the curved mouth guard 12 and communicating with the nipple 14 is for holding a flavored liquid 22. When the nipple 14 is inserted into a mouth of a baby 24 and the baby 24 sucks on the nipple 14, the baby 24 will self feed on the flavored liquid 22.

Figure 5:
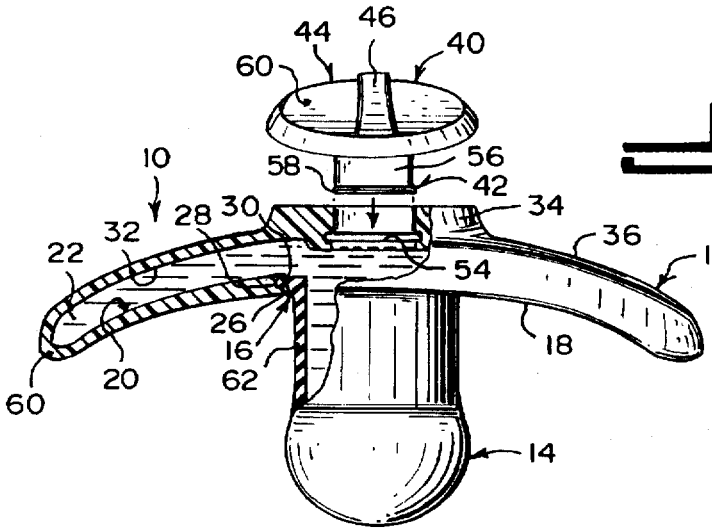
FIG. 5 is an electrical view of the instant invention with parts broken away and in section, showing a snap on cap removed from the neck with the flavored liquid in a chamber of the mouth guard and nipple.

The attaching facility 16, as shown in FIG. 5, includes the curved mouth guard 12 having an annular aperture 26 with an inner seat 28 formed centrally within the concave side 18. The nipple 14 has an annular flange 30 which snap fits onto the inner seat 28 of the annular aperture 26 in a sealed manner. The holding structure 20 is a chamber 32 completely formed within the curved mouth guard 12, that is fluidly connected to the nipple 14. The chamber 32 will retain the flavored liquid 22 therein, until the baby 24 sucks on the nipple 14 and removes the flavored liquid 22.

The curved mouth guard 12 has an open neck 34 centrally formed on a convex side 36 directly over the nipple 14. The open neck 34 will allow the flavored liquid 22 to be poured out of a container 38, into the chamber 32 and the nipple 14 (see FIG. 4). A component 40 is for covering the open neck 34. An assembly 42 is for sealing the covering component 40 to the open neck 34 in a removable manner, so as to prevent leakage of the flavored liquid 22 therefrom.

The covering component 40 is a cap 44. The cap 44 includes a finger grip 46 extending upwardly therefrom. A person can grasp the finger grip 46 to maneuver the cap 44 when being placed on and removed from the open neck 34 on the curved mouth guard 12.

Figure 4:
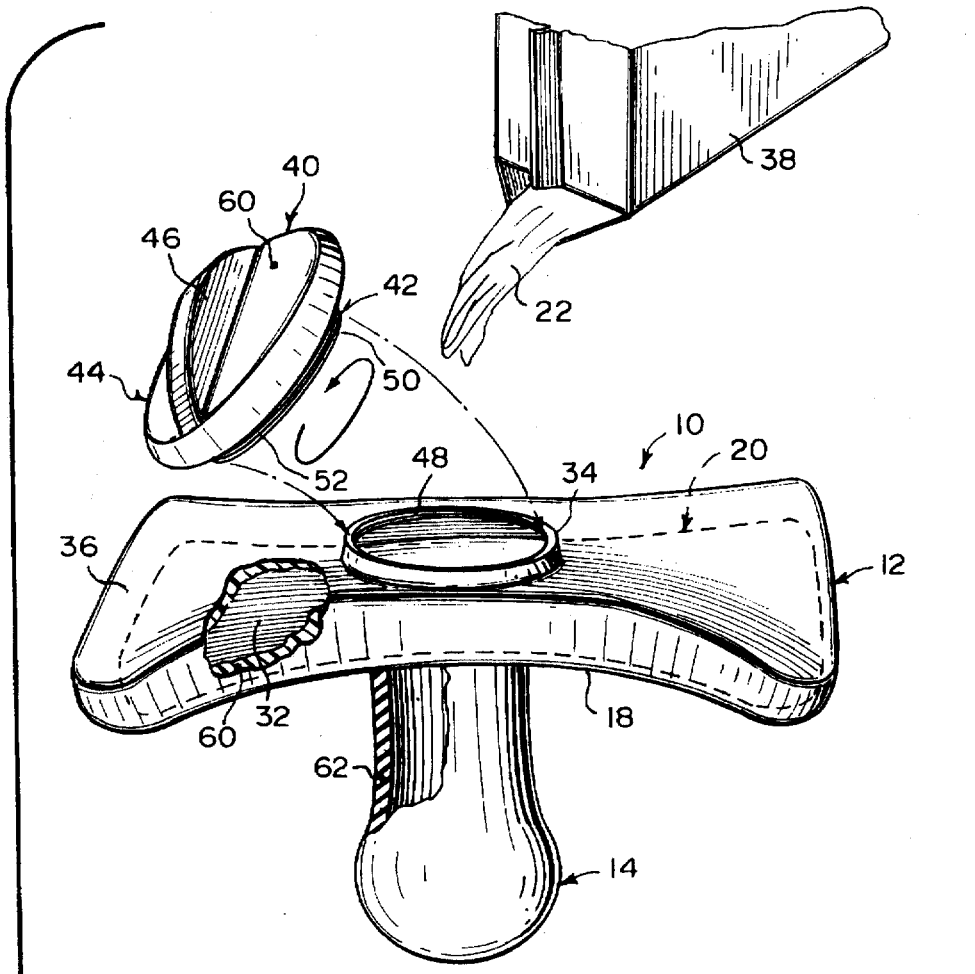
FIG. 4 is a perspective view of the instant invention with parts broken away and in section, showing a screw on cap removed from the neck with a flavored liquid starting to be poured from a container into the neck.

The sealing assembly in FIG. 4, consists of the open neck 34 of the curved mouth guard 12 having internal threads 48. The cap 44 has a collar 50 with external threads 52 which will engage with the internal threads 48 in the open neck 34. When the collar 50 is tightened within the open neck 34, the flavored liquid 22 will not leak out.

The sealing assembly 42 in FIG. 5, includes the open neck 34 of the curved mouth guard 12 having an internal groove 54. The cap 44 has a projection 56 with a flange 58 thereon. When the projection 56 is inserted within the open neck 34, the flange 58 will engage with the internal groove 54, the flavored liquid 22 will not leak out.

The curved mouth guard 12 is fabricated out of a durable plastic material 60, while the nipple 14 is fabricated out of a flexible rubber material 62. The covering component 40 is also fabricated out of the durable plastic material 60.

OPERATION OF THE INVENTION

To use the appetizing pacifier 10, the following steps should be taken:

1. Remove the cap 44 from the open neck 34 on the curved mouth guard 12.
2. Hold the container 38 by one hand.
3. Hold the curved mouth guard 12 in another hand with the open neck 34 facing up.
4. Pour the flavored liquid 22 out of the container 38 and into the open neck 34 until the chamber 32 is full.

5. Replace the cap 44 back onto the open neck 34 on the curved mouth guard 12.

6. Insert the nipple 14 into the mouth of the baby 24, to allow the baby 24 to suck on the nipple 14 and self feed on the flavored liquid 22.

LIST OF REFERENCE NUMBERS 10 appetizing pacifier
12 curved mouth guard of 10
14 nipple of 10
16 attaching facility of 10
18 concave side of 12
20 holding structure of 10 for 22
22 flavored liquid in 20 and 14
24 baby
26 annular aperture 26 of 16
28 inner seat in 26
30 annular flange on 14 of 16
32 chamber for 20
34 open neck of 12 on 36
36 convex side of 12
38 container for 22
40 covering component of 10
42 sealing assembly between 34 and 40
44 cap for 40
46 finger grip on 44
48 internal threads in 34
50 collar on 44
52 external threads on 50
54 internal groove in 34
56 projection on 44
58 flange on 56
60 durable plastic material for 12 and 40
62 flexible rubber material for 14

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An appetizing pacifier comprising:

a) a curved mouth guard;

b) a nipple;

c) means for attaching said nipple centrally to a concave side of said curved mouth guard, so that said nipple will extend from said curved mouth guard; and d) means within said curved mouth guard and communicating with said nipple, for holding a flavored liquid, so that when said nipple is inserted into a mouth of a baby and the baby sucks on said nipple, the baby will self feed on the flavored liquid, said holding means comprising a chamber completely formed within said curved mouth guard, said chamber being fluidly connected to said nipple, whereby said chamber will retain the flavored liquid therein, until the baby sucks on said nipple and removes the flavored liquid.

2. An appetizing pacifier as recited in claim 1, wherein said attaching means includes:

a) said curved mouth guard having an annular aperture with an inner seat formed centrally within said concave side; and b) said nipple having an annular flange which snap fits onto said inner seat of said annular aperture in a sealed manner.

3. An appetizing pacifier as recited in claim 1, further including:

a) said curved mouth guard having an open neck centrally formed on a convex side directly over said nipple, so that said open neck will allow the flavored liquid to be poured out of a container, into said chamber and said nipple;

b) means for covering said open neck; and c) means for sealing said covering means to said open neck in a removable manner, so as to prevent leakage of the flavored liquid therefrom.

4. An appetizing pacifier as recited in claim 3, wherein said covering means is a cap.

5. An appetizing pacifier as recited in claim 4, wherein said cap includes a finger grip extending upwardly therefrom, so that a person can grasp said finger grip to maneuver said cap when being placed on and removed from said open neck on said curved mouth guard.

6. An appetizing pacifier as recited in claim 4, wherein said sealing means includes:

a) said open neck of said curved mouth guard having internal threads; and b) said cap having a collar with external threads which will engage with said internal threads in said open neck, so that when said collar is tightened within said open neck the flavored liquid will not leak out.

7. An appetizing pacifier as recited in claim 4, wherein said sealing means includes:

a) said open neck of said curved mouth guard having an internal groove; and b) said cap having a projection with a flange thereon, so that when said projection is inserted within said open neck, said flange will engage with said internal groove and the flavored liquid will not leak out.

8. An appetizing pacifier as recited in claim 1, wherein said curved mouth guard is fabricated out of a durable plastic material, while said nipple is fabricated out of a flexible rubber material.

9. An appetizing pacifier as recited in claim 3, wherein said covering means is fabricated out of a durable plastic material.

10. An appetizing pacifier comprising:

a) a curved mouth guard;

b) a nipple;

c) means for attaching said nipple centrally to a concave side of said curved mouth guard, so that said nipple will extend from said curved mouth guard, said attaching means includes said curved mouth guard having an annular aperture with inner seat formed centrally within said concave side and said nipple having an annular flange which snap fits onto said inner seat of said annular aperture in a sealed manner; and d) means within said curved mouth guard and communicating with said nipple, for holding a flavored liquid, so that when said nipple is inserted into a mouth of a baby and the baby sucks on said nipple, the baby will self feed on the flavored liquid, said holding means comprising a chamber completely formed within said curved mouth guard, that is fluidly connected to said nipple, whereby said chamber will retain the flavored liquid therein, until the baby sucks on said nipple and removes the flavored liquid.

11. An appetizing pacifier as recited in claim 10, further including:

a) said curved mouth guard having an open neck centrally formed on a convex side directly over said nipple, so that said open neck will allow the flavored liquid to be poured out of a container, into said chamber and said nipple;

b) means for covering said open neck; and c) means for sealing said covering means to said open neck in a removable manner, so as to prevent leakage of the flavored liquid therefrom.

12. An appetizing pacifier as recited in claim 11, wherein said covering means is a cap.

13. An appetizing pacifier as recited in claim 12, wherein said cap includes a finger grip extending upwardly therefrom, so that a person can grasp said finger grip to maneuver said cap when being placed on and removed from said open neck on said curved mouth guard.

14. An appetizing pacifier as recited in claim 13, wherein said sealing means includes:

a) said open neck of said curved mouth guard having internal threads; and b) said cap having a collar with external threads which will engage with said internal threads in said open neck, so that when said collar is tightened within said open neck the flavored liquid will not leak out.

15. An appetizing pacifier as recited in claim 13, wherein said sealing means includes:

a) said open neck of said curved mouth guard having an internal groove; and b) said cap having a projection with a flange thereon, so that when said projection is inserted within said open neck, said flange will engage with said internal groove and the flavored liquid will not leak out.

16. An appetizing pacifier as recited in claim 13, wherein said curved mouth guard is fabricated out of a durable plastic material, while said nipple is fabricated out of a flexible rubber material.

17. An appetizing pacifier as recited in claim 16, wherein said covering means is fabricated out of a durable plastic material.

* * * * *